US007020416B2

(12) United States Patent
Kato et al.

(10) Patent No.: US 7,020,416 B2
(45) Date of Patent: Mar. 28, 2006

(54) IMAGE FORMING APPARATUS WITH ARRANGEMENT FOR CONTROLLING ASSEMBLY ORDER

(75) Inventors: Keiji Kato, Nara (JP); Toshio Nishino, Yamatokoriyama (JP); Yasuyuki Ishiguro, Higashiosaka (JP); Fumito Mizoguchi, Nara (JP); Wataru Yoshida, Hirakata (JP); Atsushi Inoue, Nara (JP); Toshihide Ohgoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 97 days.

(21) Appl. No.: 10/669,315

(22) Filed: Sep. 25, 2003

(65) Prior Publication Data

US 2004/0062566 A1 Apr. 1, 2004

(30) Foreign Application Priority Data

Sep. 27, 2002 (JP) ..... 2002-283755

(51) Int. Cl.
*G03G 15/00* (2006.01)

(52) U.S. Cl. ..... 399/110; 399/116; 399/119

(58) Field of Classification Search ..... 399/110, 399/113, 116, 119
See application file for complete search history.

(56) References Cited

U.S. PATENT DOCUMENTS

| | | | | |
|---|---|---|---|---|
| 4,821,063 | A | 4/1989 | Kaneshige | |
| 4,912,509 | A * | 3/1990 | Kaneshige | 399/119 |
| 5,697,008 | A * | 12/1997 | Katoh et al. | 399/35 |
| 6,088,555 | A | 7/2000 | Mizuno | |
| 6,678,489 | B1 * | 1/2004 | Carter et al. | 399/113 |
| 6,785,492 | B1 * | 8/2004 | Tanizaki et al. | 399/113 |
| 6,853,821 | B1 * | 2/2005 | Ishiguro et al. | 399/119 |

FOREIGN PATENT DOCUMENTS

| | | | |
|---|---|---|---|
| JP | 62-272283 | A | 11/1987 |
| JP | 5-6037 | A | 1/1993 |
| JP | 10-268734 | A | 10/1998 |

* cited by examiner

*Primary Examiner*—Arthur T. Grimley
*Assistant Examiner*—Ryan Gleitz
(74) *Attorney, Agent, or Firm*—Birch, Stewart, Kolasch & Birch, LLP

(57) ABSTRACT

The process frame body has the guide portion, and the development device has the to-be-guided shaft. When the process frame body is unattached to the apparatus main body, the guide portion of the development device is absent, thus preventing proper attachment and positioning of the development device. The convex engagement portion is formed integrally with the development device so as to jut into the attachment path for the process frame body. This prevents attachment of the process frame body when the development device is attached first. If users try to attach the process frame body after attachment of the development device, the convex engagement portion interferes with the process frame body, thus preventing attachment of the process frame body.

11 Claims, 12 Drawing Sheets

IMAGE FORMING APPARATUS WITH ARRANGEMENT FOR CONTROLLING ASSEMBLY ORDER

This nonprovisional application claims priority under 35 U.S.C. § 119(a) on Patent Application No. JP2002-283755 filed in JAPAN on Sep. 27, 2002, which is herein incorporated by reference.

BACKGROUND OF THE INVENTION

1. Field of the Invention

The present invention relates to an electrophotographic image forming apparatus such as a laser beam printer, a copier, and a facsimile machine, and more particularly to an image forming apparatus in which a development unit, a photoconductive unit, and the like are made attachable and detachable.

2. Description of the Related Art

In an electrophotographic image forming apparatus, image formation is basically conducted in the following order. At first, a surface of a photoconductive body is uniformly charged by a charging device, and then a laser beam is applied to the photoconductive body surface to thereby form an electrostatic latent image thereon. Subsequently, on the photoconductive body surface carrying the electrostatic latent image is attached toner which has been charged in a potential reverse to the potential of the latent image portion, thereby visualizing the electrostatic latent image. In this way, the toner deposited on the photoconductive body surface is transferred onto a recording medium such as a paper sheet.

Most of the components for use in image formation, such as the photoconductive body, the charging device, and the toner, are consumable articles. To achieve a streamlining in maintenance and care, these components are classified and unitized according to their configurations in the apparatus, functions, differences in service life, etc, to form, for example a photoconductive unit and a development unit. Some units are made attachable to and detachable from the apparatus main body. Moreover, heavily-consumed and frequently-replaced portions, such as toner of the development unit and a member for holding the toner, are formed into a cartridge structure, for example a toner cartridge, which is made attachable to and detachable from the unit main body.

Further, in a compact image forming apparatus that satisfies user's demand for saving in space, each unit and other functional components other than the units are arranged and housed within the image forming apparatus main body at high density and with high accuracy.

Usually in such a compact image forming apparatus, replacement of its constituent units and functional components has to be conducted in accordance with a predetermined attachment/detachment order because of a restriction in function or structure, for example positioning accuracy among a plurality of units. Thus, operators or users carry out replacement in accordance with the attachment/detachment order, looking at an operation manual or the like.

In cases where a plurality of units of different types are provided that are made attachable to and detachable from the image forming apparatus main body, these units must be mounted so as not to interfere with each section of the apparatus main body, with highly accurate positional relationship maintained among the units. Thus, it is imperative that each unit be attached and detached, in a predetermined order, along a predetermined attachment path, by means of a guide formed in the apparatus main body.

Taken up as one explanatory example is an image forming apparatus disclosed in Japanese Unexamined Patent Publication JP-A 62-272283 (1987). This image forming apparatus includes an image forming unit and a development device. The image forming unit is composed of a photoconductive drum, a charging device, a cleaning device, etc. On attachment of the image forming unit and the development device to the image forming apparatus main body, first comes the image forming unit, then the development device. On detachment of the image forming unit and the development device from the image forming apparatus main body, first comes the development device, then the image forming unit.

More specifically, the image forming unit is attached to the image forming apparatus main body first, and, after the development device is guided by an attachment guide which is formed integrally with the image forming unit, the attachment guide co-operates with a positioning boss which is formed in the development device, and thereby the positioning boss is fitted into a positioning hole formed in the image forming unit. As a result, the development device is accurately positioned with respect to the photoconductive body surface of the image forming unit. Moreover, the positioning boss and the positioning hole constitute retaining means. By fitting the positioning boss into the positioning hole of the image forming unit, the development device is retained in the image forming apparatus main body so as to press-support the image forming unit. In this way, the development device cannot be mounted unless the image forming unit is attached to the image forming apparatus main body. With this structure, occurrence of an error in the unit attachment order can be prevented.

Taken up as another example is an electrophotographic apparatus disclosed in Japanese Unexamined Patent Publication JP-A 5-6037 (1993). In this construction, the attachment order is that after the photoconductive unit is attached to the apparatus main body, the development unit is attached thereto. If the development unit is attached to the apparatus main body first, a regulating member provided in the apparatus main body is shifted to a regulation position to regulate the attachment of the photoconductive unit. On the other hand, the detachment order is reverse to the attachment order, that is, after the development unit is detached from the apparatus main body, the photoconductive unit is detached therefrom. In the attachment of the development unit, the regulating member remains at a regulation position to regulate the detachment of the photoconductive unit. In this way, by the action of the regulating member provided in the electrophotographic apparatus main body, occurrence of an error in the unit attachment/detachment order can be prevented.

Taken up as still another example is an image forming apparatus disclosed in Japanese Unexamined Patent Publication JP-A 10-268734 (1998). In this construction, the attachment order is that, after a photoconductive body cartridge is attached to the image forming apparatus main body, a development device cartridge is attached thereto. Note that the "cartridge" described in JP-A 10-268734 corresponds to the "unit" described in the present specification in question. A guide portion provided in the photoconductive body cartridge and a guide groove formed in the apparatus main body co-operate with each other, so that the development device cartridge is guided to the attachment position. With this structure, when an attachment worker tries to attach the development device cartridge to be attached subsequently in a state where the photoconductive body cartridge to be attached firstly remains unattached, since the development device cartridge cannot be guided by the to-be-attached-first photoconductive body cartridge, the attachment of the development device cartridge turns out to be difficult. Hereupon, the attachment worker is able to find immediately an error in the attachment order.

However, in the case of handling the above-described conventional image forming apparatuses, in reality, users do not always abide by the predetermined order in which the functional units are attached. Thus, if the units are attached forcibly in an erroneous order, the image forming apparatus suffers from damage caused by interference between the units, or interference between the unit and the other member disposed within the apparatus main body.

The image forming apparatus disclosed in JP-A 62-272283 pays no regard to safety and prevention of an error in the order in which the development device and the image forming unit are detached from the apparatus main body. That is, even though at first the means for retaining the development device is operated to release the retention to the apparatus main body and the detachment operation is carried out in a proper order, within the apparatus main body, separation between the development unit (to be detached from the apparatus main body first) and the image forming unit (to be detached therefrom subsequently) ends in imperfect. As a result, there is a possibility that the development and image-forming units are pulled out in a mutually-coupled state. This is because the positioning boss formed in the development device and the positioning hole formed in the image forming unit are tightly engaged with each other in order to secure positional accuracy between the development unit and the image forming unit. If the development and image-forming units are pulled out in a mutually-coupled state, there is a danger of them being separated and fall off at the instant when detached from the apparatus main body. Another problem is that the to-be-detached-first development unit cannot be removed smoothly from the apparatus main body.

Moreover, in cases where the functional units are so designed as to prevent an error in the attachment order, the attachment path, through which the units are guidedly directed to the attachment position, becomes inevitably complicated. For example, in the constructions disclosed in JP-A 5-6037 and JP-A 10-268734, a shutter operating mechanism is provided in the unit and the attachment path. The shutter operating mechanism acts to open and close a shutter, only when the unit is attached and detached in a proper order, by exploiting the relative movement between the unit and the other unit or the member within the apparatus main body. The shutter is disposed in the development unit as a mechanism for opening and closing a toner supply port, which is opened only when the unit is attached in a proper order, in a state where toner is provided in a predetermined development portion, but meanwhile held closed, when the unit is attached in an erroneous order or the unit is brought to a standstill partway along the attachment path, so as to stop toner supply. In this way, when attached in an erroneous order, the unit no longer functions properly, so that users become aware of the erroneous order. Hence, occurrence of an error in the attachment order can be prevented. In such a structure, however, not only the attachment path but also the unit needs to have a complicated configuration. Furthermore, in the construction disclosed in JP-A 5-6037, since the regulating member is composed of a plurality of members including a rotation transfer gear and an urging spring, the attachment path is increased in complexity.

As explained thus far, in the conventional image forming apparatuses, although errors can be prevented from occurring in the orders in which a plurality of units are attached and detached, the path for attachment of each unit becomes inevitably complicated. This gives rise to a problem that some users find it difficult to place the unit in a predetermined position of the apparatus main body properly.

In particular, if the apparatus is inadvertently activated in a state where the unit is not placed in the attachment position properly due to the interference between the unit and the member being moved along the attachment path, it is impossible to make full use of the capabilities of the apparatus, let alone each component may suffer from damage due to misregistration of the units.

SUMMARY OF THE INVENTION

An object of the invention is to provide an image forming apparatus which succeeded in preventing breakage of functional units or constituent members of the image forming apparatus main body when a plurality of functional units are attached thereto and detached therefrom by users.

The invention provides an image forming apparatus comprising:

an image forming apparatus main body; and a plurality of functional units, of which each is composed of a combination of a plurality of components and has a certain image-forming capability, the plurality of functional units being attachable to and detachable from the image forming apparatus in a predetermined order, each of the functional units having attachment/detachment order controlling means for preventing the other functional unit from being attached and detached in an order different from the predetermined order.

According to the invention, a plurality of functional units, of which each is composed of a combination of a plurality of components and has a certain image-forming capability, are each made attachable to and detachable from the image forming apparatus main body in the predetermined order.

When users or workers try to carry out attachment and detachment of the functional unit to and from the image forming apparatus main body in an order different from the predetermined order, the attachment/detachment order controlling means provided in the functional unit prevents attachment and detachment of the other functional unit.

In order for the functional units to be arranged within the image forming apparatus main body at high density and with high accuracy, attachment and detachment operations need to be conducted in the predetermined orders. When the attachment or detachment operation is conducted in an order different from the predetermined order, there is a possibility that the functional unit and the image forming apparatus main body suffer from breakage.

According to the invention, the attachment and detachment of the functional unit can be conducted properly in the predetermined orders by the attachment/detachment order controlling means. Thus, when a plurality of functional units are attached and detached by users, the functional units or the members constituting the image forming apparatus main body can be protected from breakage attributed to an error in the attachment/detachment order.

The invention further provides an image forming apparatus comprising:

an image forming apparatus main body;

a process frame body including at least a photoconductive body, image forming means for forming an electrostatic latent image on a surface of the photoconductive body, and a frame main body for holding the photoconductive body and the image forming means; and a development device including at least development means for developing the electrostatic latent image using toner, toner supply means for feeding toner to the development means, and a development device main body for holding the development means and the toner supply means, the process frame body and the development device being attachable to and detachable from the image forming apparatus main body in a predetermined order, the process frame body and the development device each having attachment/detachment order controlling means for preventing the process frame body and the development device from being attached and detached in an order different from the predetermined order.

According to the invention, the process frame body and the development device are each made attachable to and detachable from the image forming apparatus main body in the predetermined order. The process frame body includes at least the photoconductive body, the image forming means for forming an electrostatic latent image on the surface of the photoconductive body, and the frame main body for holding the photoconductive body and the image forming means. The development device includes at least the development means for developing the electrostatic latent image using toner, the toner supply means for feeding toner to the development means, and the development device main body for holding the development means and the toner supply means.

When users or workers try to carry out attachment and detachment of the process frame body and the development device to and from the image forming apparatus main body in an order different from the predetermined order, the attachment/detachment order controlling means provided in the process frame body and the development device prevents attachment and detachment of the process frame body and the development device.

In order for the process frame body and the development device to be arranged within the image forming apparatus main body at high density and with high accuracy, the attachment and detachment operations need to be conducted in the predetermined orders. When the attachment or detachment operation is conducted in an order different from the predetermined order, there is a possibility that the process frame body, the development device, and the image forming apparatus main body suffer from breakage.

According to the invention, the attachment and detachment of the process frame body and the development device can be conducted properly in the predetermined orders by the attachment/detachment order controlling means. Thus, when the process frame body and the development device are attached and detached by users, the process frame body and the development device, or the members constituting the image forming apparatus main body can be protected from breakage attributed to an error in the attachment/detachment order.

In the invention, it is preferable that the attachment/detachment order controlling means is created by forming part of each of the process frame body and the development device into a certain shape.

According to the invention, the attachment/detachment order controlling means is created by forming part of each of the process frame body and the development device into a certain shape.

In this way, the attachment/detachment order controlling means can be formed integrally with each of the process frame body and the development device. This eliminates the need for attachment of extra components to constitute the attachment/detachment order controlling means, which results in the manufacturing process being facilitated and the manufacturing cost being reduced.

In the invention, it is preferable that the attachment/detachment order controlling means is built as an engagement portion which is, in the attachment of the process frame body and the development device, brought into engagement state in association with attachment operation of the component to be attached subsequently, and is, in the detachment of the process frame body and the development device, brought into disengagement state in association with detachment operation of the component to be detached first.

According to the invention, in the attachment of the process frame body and the development device, the engagement portions acting as the attachment/detachment order controlling means are engaged with each other in association with the attachment operation of the component to be attached subsequently by user's operation. On the other hand, in the detachment of the process frame body and the development device, the engagement portions are disengaged from each other in association with the detachment operation of the component to be detached first by user's operation.

In this way, the engagement portions are brought into engagement or disengagement state in association with the operation of the process frame body and the development device. This eliminates the need for a driving mechanism or an electrical controlling device, which results in the structures of the process frame body and the development device being simplified and thus the attachment and detachment operations being easier.

In the invention, it is preferable that, of the engagement portions respectively provided in the process frame body and the development device, one is formed as a convexity and another is formed as a concavity whose configuration conforms to that of the convexity.

According to the invention, the engagement portions have simple convex/concave configurations. Thus, of the engagement portions respectively provided in the process frame body and the development device, one is formed as a convexity and the other is formed as a concavity whose configuration conforms to that of the convexity.

In this way, the attachment path, as well as the structures of the process frame body and the development device, can be simplified, which results in the attachment and detachment operations being easier.

In the invention, it is preferable that, in cases where the order of attachment of the process frame body and development device is such that first the process frame body is attached and then the development device is attached, the attachment/detachment order controlling means of the process frame body is formed of a guide portion for guiding the attachment of the development device, whereas the attachment/detachment order controlling means of the development device is formed of a to-be-guided portion which is guided by the guide portion.

According to the invention, on the attachment order of the process frame body and the development device, first comes the process frame body, then the development device. In this case, the attachment/detachment order controlling means of the process frame body is formed of a guide portion for guiding the attachment of the development device, whereas the attachment/detachment order controlling means of the development device is formed of a to-be-guided portion which is guided by the guide portion.

In this way, even if users try to attach the development device without attaching the process frame body first, since the guide portion for guiding the to-be-guided portion of the development device is absent at that point, the development device cannot be attached. Thus, occurrence of an error in the attachment order for the process frame body and the development device can be prevented without fail.

In the invention, it is preferable that the process frame body further comprises frame securing means which is, in the attachment operation, fitted to a certain portion of the apparatus main body to secure the process frame body, and releases, in the detachment operation, the fitting to the certain portion by user's operation, and that, in cases where the order in which the process frame body and the development device are detached is that first comes the development device, then the process frame body, the attachment/detachment order controlling means of the development device has an inhibitory portion for inhibiting operation of the frame securing means by users, when the process frame body and the development device are attached.

According to the invention, the process frame body is fixedly fitted, at its frame securing means, to a certain portion of the apparatus main body when attached, and the fitting to the certain portion is released, when detached, by the operation of the frame securing means by users.

In cases where the order in which the process frame body and the development device are detached is that first comes the development device, then the process frame body, the inhibitory portion, namely, part of the attachment/detachment order controlling means of the development device, inhibits the operation of the frame securing means by users, when the process frame body and the development device are attached.

In this way, even if users try to detach the process frame body without detaching the development device first, since the frame securing means cannot be operated at that point, the process frame body is prevented from being released and detached. Thus, occurrence of an error in the detachment order for the process frame body and the development device can be prevented without fail.

In the invention, it is preferable that, in the attachment of the process frame body and the development device, the inhibitory portion covers the frame securing means in association with the attachment operation of the component to be attached subsequently, and meanwhile, in the detachment of the process frame body and the development device, the inhibitory portion releases the frame securing means in association with the detachment operation of the development device.

According to the invention, when the process frame body and the development device are attached, the inhibitory portion covers the frame securing means in association with the attachment operation of the component to be attached subsequently by user's operation, and meanwhile, when the process frame body and the development device are detached, the inhibitory portion releases the frame securing means in association with the detachment operation of the development device by user's operation.

In this way, the inhibitory portion covers and releases the frame securing means in association with the operation of the process frame body and the development device. Thus, the inhibitory portion can be readily provided without preparing a driving mechanism or an electrical controlling device.

In the invention, it is preferable that the development device further comprises pressure-contact means for contacting under pressure or separating the photoconductive body and the development means by user's operation, when the process frame body and the development device are attached.

According to the invention, the pressure-contact means of the development device acts to contact under pressure or separate the photoconductive body and the development means by user's operation, when the process frame body and the development device are attached.

In this way, in the attachment of the development device, at first the pressure-contact means is so operated as to separate the photoconductive body and the development means, and, after completion of the attachment, the pressure-contact means is so operated as to contact the photoconductive body and the development means under pressure. This makes it possible to prevent occurrence of breakage attributed to the abutment between the photoconductive body and the development means during the attachment of the development device. Also in the detachment of the development device, at first the pressure-contact means is so operated as to separate the photoconductive body and the development means. This makes it possible to prevent occurrence of breakage attributed to the abutment between the photoconductive body and the development means during the detachment of the development device.

In the invention, it is preferable that the toner supply means is made attachable to and detachable from the development device main body, and that the pressure-contact means acts to contact under pressure or separate the photoconductive body and the development means in accordance with the attachment and detachment of the toner supply means to and from the development device.

According to the invention, the toner supply means is made attachable to and detachable from the development device main body. When the toner supply means is attached to the development device, the pressure-contact means contacts the photoconductive body and the development means under pressure. On the other hand, when the toner supply means is detached from the development device, the pressure-contact means separates the photoconductive body and the development means.

In this way, in the attachment of the development device, by attaching the development device main body to the apparatus main body without mounting the toner supply means, the development device can be attached, with the photoconductive body and the development means kept in a separated state. This makes it possible to prevent occurrence of breakage attributed to the abutment between the photoconductive body and the development means during the attachment of the development device. Also in the detachment of the development device, by detaching the toner supply means from the development device main body prior to the detachment of the development device main body from the apparatus main body, the development device can be detached, with the photoconductive body and the development means kept in a separated state. This makes it possible to prevent occurrence of breakage attributed to the abutment between the photoconductive body and the development means during the detachment of the development device.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
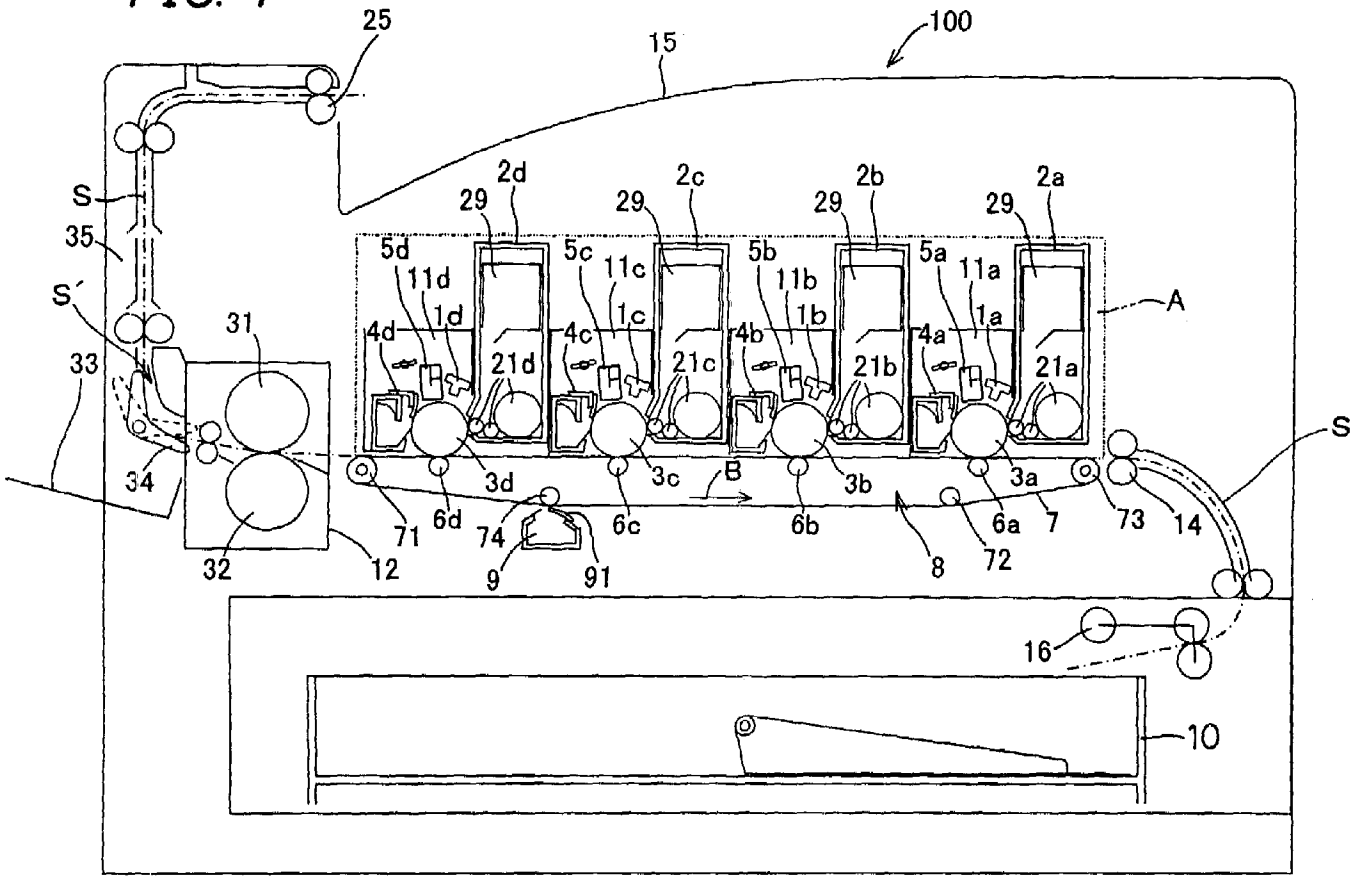
FIG. 1 is a sectional view showing a structure of an image forming apparatus of one embodiment according to the invention.

Now referring to the drawings, preferred embodiments of the invention are described below.

FIG. 1 is a sectional view showing a structure of an image forming apparatus 100 of one embodiment according to the invention. The image forming apparatus 100 is, like a laser beam printer, designed to form multi-color or monochrome images onto a certain sheet (recording paper) in response to image data transmitted externally of the apparatus. As shown in FIG. 1, the image forming apparatus 100 is composed of: an exposure device 1; a development device 2; a photoconductive drum 3; a charging device 5; a cleaner unit 4; a transfer-conveyance belt unit 8; a fixing unit 12; a sheet conveying path S; a sheet feeding tray 10; and a sheet discharge tray 15, 33. Note that the image forming apparatus 100 deals with image data on color images represented by several colors: black (K); cyan (C); magenta (M); and yellow (Y). Hence, to form latent images of four colors, the exposure device 1 (1*a*, 1*b*, 1*c*, and 1*d*); the development device 2 (2*a*, 2*b*, 2*c*, and 2*d*); the photoconductive drum 3 (3*a*, 3*b*, 3*c*, and 3*d*); the cleaner unit 4 (4*a*, 4*b*, 4*c*, and 4*d*); and the charging device 5 (5*a*, 5*b*, 5*c*, and 5*d*) each need to be four in numbers. Note that the alphabet letters a, b, c, and d attached to the reference numerals 1 to 5 represent black, cyan, magenta, and yellow, respectively. Within the image forming apparatus 100, the exposure device 1; the development device 2; the photoconductive drum 3 (3*a*, 3*b*, 3*c*, and 3*d*); the cleaner unit 4; the charging device 5; and other nearby components constitute an image forming section A.

The photoconductive drum 3 is made of an organic photosensitive substance. The charging device 5 applies electric charge of predetermined potential evenly over the surface of the photoconductive drum 3. The charging device 5 types include a roller-or brush-type charging device and a charger-type device as shown in FIG. 1. The former performs charging by making contact with the photoconductive drum, whereas the latter performs charging by electric discharge. In the exposure device 1, using an LED (Light Emitting Diode) write head, which is formed by arranging light-emitting elements in an array, or a laser scanning unit (LSU) having a laser irradiating portion and a reflecting mirror, the surface of the photoconductive drum 3 having been charged by the charging device 5 is exposed to light in accordance with image data; wherefore an electrostatic latent image corresponding to the image data is created. The exposure device 1 and the charging device 5 constitute image forming means. The cleaner unit 4 removes and collects residual toner remaining on the photoconductive drum 3 surface after development and image transfer operations.

The exposure device 1, the photoconductive drum 3, the cleaner unit 4, and the charging device 5 are housed integrally in a casing built as a frame main body, so as to constitute a process frame body 11 acting as a functional unit.

A development roller 21 is composed of one or a plurality of rollers which are made rotatable about a rotary shaft arranged substantially parallel to the rotary shaft of the photoconductive drum 3. Upon feeding the toner of several colors (K, C, M, and Y) accommodated in the toner cartridge 29 to the development roller 21, the development roller 21 is rotated to feed the toner to the photoconductive drum 3 arranged in contact with the development roller 21. In this way, the electrostatic latent image formed on the photoconductive drum 3 is developed as a toner image. Inside the toner cartridge 29, the toner accommodated therein is charged with electric charge reverse to that of the electrostatic latent image formed by the exposure device 1 through, for example, agitation.

The development roller 21, acting as development means, and the toner cartridge 29, acting as loner supply means, are housed integrally in a casing built as a development device main body, so as to constitute a development device 2 acting as a functional unit.

Arranged below the photoconductive drum 3, as viewed in the figure, is the transfer-conveyance belt unit 8 including a transfer belt 7; a transfer belt driving roller 71; a transfer belt tension roller 73; a transfer belt follower roller 72, 74; a transfer roller 6 (6*a*, 6*b*, 6*c*, and 6*d*); and a transfer belt cleaning unit 9.

The transfer belt driving roller 71, the transfer belt tension roller 73, the transfer roller 6, and the transfer belt follower roller 72, 74 each bring the transfer belt 7 into a suspended state and drive the transfer belt 7 to rotate in a direction indicated by the arrow B.

The transfer belt 7 conveys a recording sheet so that the toner image formed on the photoconductive drum 3 surface is transferred onto the recording sheet. As shown in the figure, the transfer belt 7 is so configured as to make contact with all of the photoconductive drum portions 3*a* to 3*d*. This allows the toner images of several colors to be successively and superimposedly transferred onto a single piece of recording sheet. The transfer belt 7 is formed as an endless belt using a 100 to 150 μm-thick film.

A toner image is transferred from the photoconductive drum 3 onto a recording sheet by the transfer roller 6 which is arranged face to face with the photoconductive drum 3, with the transfer belt 7 disposed therebetween. To achieve transfer of a toner image, a high-voltage transfer bias (high voltage of a polarity (+) reverse to the polarity (−) of the charged toner) is applied to the transfer roller 6. The transfer roller 6 is basically formed of a metal shaft (for example, stainless) which is 8 to 10 mm in diameter, and has its surface coated with an electrically conductive elastic material (for example, EPDM (ethylene-propylenediene ternary copolymer) or foamed urethane). By using such a conductive elastic material, a high voltage can be applied uniformly to a recording sheet. In this embodiment, although the transfer roller 6 is used as a transfer electrode, a brush or the like may be used instead.

Moreover, there is a possibility that, when that part of the transfer belt 7 which is not responsible for conveyance of a recording sheet is brought into direct contact with the photoconductive drum 3, the toner deposited on the photoconductive drum 3 surface adheres to the transfer belt 7. In this case, the toner adhering to the transfer belt 7 smears the other surface of the recording sheet opposite to the surface onto which a toner image is transferred, during recording sheet conveyance. To prevent this, the toner adhering to the transfer belt 7 is removed and collected by the transfer belt cleaning unit 9. The transfer belt cleaning unit 9 is provided with a cleaning member making contact with the transfer belt 7, for example, a cleaning blade 91. That part of the transfer belt 7 which is contacted by the cleaning blade 91 is pressed into contact with the cleaning blade 91 by the transfer belt follower roller 74 arranged face to face with the cleaning blade 91; wherefore the toner adhering to the transfer belt 7 is scraped by the cleaning blade 91.

The sheet feeding tray 10, for stacking thereon recording sheets used for image formation, is disposed below the image forming section A. Moreover, disposed above the image forming apparatus 100 is the discharge tray 15 for stacking thereon recording sheets having undergone printing in a Face-Down manner. Further, disposed on the side of the image forming apparatus 100 is the discharge tray 33 for stacking thereon recording sheets having undergone printing in a Face-Up manner.

Besides, the image forming apparatus 100 incorporates the sheet conveying path S for conveying the recording sheets on the sheet feeding tray 10 to the discharge tray 15, 33 via the transfer-conveyance belt unit 8 and the fixing unit 12. In the vicinity of the sheet conveying path S are arranged a pick-up roller 16; a resist roller 14; a fixing section 12; a conveying direction switching guide 34; a conveying roller 25 for conveying recording sheets; etc.

The pick-up roller 16, which is disposed at the end of the sheet feeding tray 10, is a retrieval roller for feeding recording sheets one by one from the sheet feeding tray 10 to the sheet conveying path S. The conveying roller 25 is a small roller for facilitating and assisting conveyance of recording sheets. The conveying roller 25 is arranged plurally along the sheet conveying path S. The conveying direction switching guide 34 is disposed in a side cover 35 of the image forming apparatus 100 so as to be angularly displaceable. When the conveying direction switching guide 34 is kept in a state as indicated by the solid line, a recording sheet passes through a conveying portion S' (part of the sheet conveying path S) to be discharged onto the upper discharge tray 15. The conveying portion S' is formed between the fixing unit 12 and the side cover 35 carrying the conveying direction switching guide 34. On the other hand, when the conveying direction switching guide 34 is kept in a state as indicated by the broken line, a recording sheet having passed through the fixing unit 12 is discharged onto the discharge tray 33. In this way, by changing the status of the conveying direction switching guide 34 through angular displacement, it is possible to select which tray recording sheets are discharged onto.

The resist roller 14 temporarily holds a recording sheet being conveyed along the sheet conveying path S, and then feeds the recording sheet to the transfer-conveyance belt unit 8, with proper timing, in synchronization with the rotation of the photoconductive drum 3. Thereupon, the toner images formed on the photoconductive drum 3 are multiply transferred onto the recording sheet satisfactorily. That is, in response to a detection signal outputted from a non-illustrated resist pre-detection switch, the resist roller 14 conveys the recording sheet in such a way that the front end of each toner image formed on the photoconductive drum 3 conforms to the front end of the image formation region on the recording sheet.

The fixing unit 12 includes a heating roller 31 and a pressurizing roller 32. The heating roller 31 and the pressurizing roller 32 are so designed as to rotate while having sandwiched therebetween the recording sheet carrying a toner image transferred thereon that has been conveyed by the transfer-conveyance belt unit 8. The heating roller 31 is so adjusted as to obtain a predetermined fixation temperature in response to a signal fed from a non-illustrated temperature detecting device. By the synergistic actions of the heating roller 31 and the pressurizing roller 32, heat and pressure are applied to the recording sheet, and thereby the multiple-color toner images transferred onto the recording sheet are fused, mixed, pressurized, and eventually thermally fixed onto the recording sheet.

As explained thus far, the image forming apparatus 100 incorporates a plurality of functional units including the development device 2, the transfer-conveyance belt unit 8, the process frame body 11, and the fixing unit 12. Of these functional units, the development device 2 and the process frame body 11 will be described below in detail.

Figure 2:
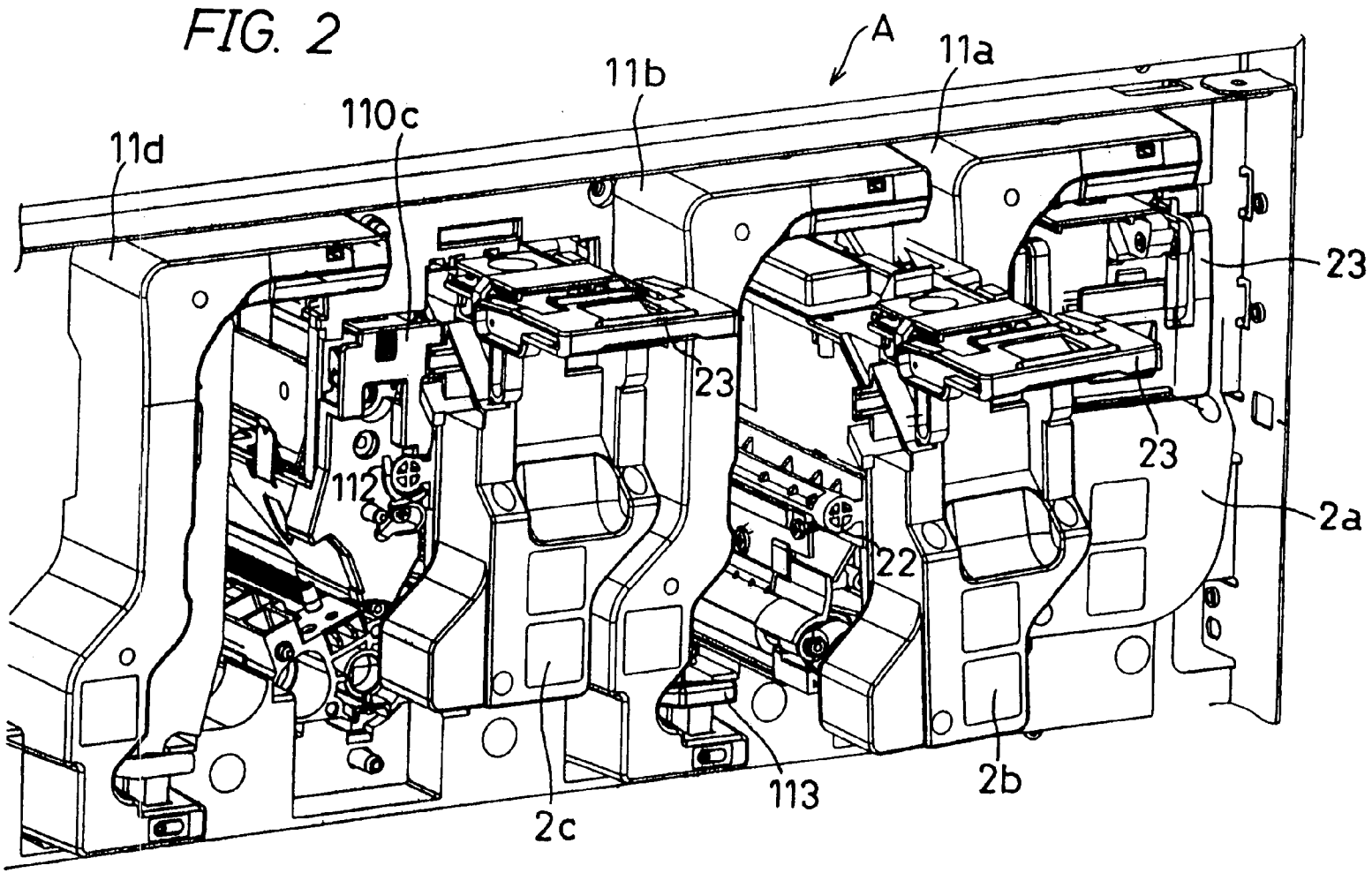
FIG. 2 is a perspective view showing an image forming section.

FIG. 2 is a perspective view showing the image forming section A. In the image forming apparatus 100 of the embodiment, the development device 2 is made attachable to and detachable from the image forming apparatus main body (hereinafter abbreviated to "apparatus main body"), as a development cartridge formed of a combination of at least the development roller 21 and the toner cartridge 29 for holding toner. The process frame body 11 is also made attachable to and detachable from the apparatus main body, as a construction formed of a combination of at least the exposure device 1, the photoconductive drum 3, the cleaner unit 4, and the charging device 5. Further, the process frame body 11 is composed of a process frame inner unit and a process frame front cover. Note that, as described previously, this embodiment is designed to perform image formation based on image data on color images represented by four colors: (C, M, Y, and K). Hence, the process frame body 11 also needs to be four in numbers (11*a*, 11*b*, 11*c*, and 11*d*) so as to correspond to each color.

In the figure, the process frame body portions 11*a*, 11*b*, and 11*d* are shown attached already. The process frame body portion to the development device portion 2*c* is shown arranged with its process frame front cover removed in the interest of understanding of the attachment status of the process frame inner unit 110*c*. The process frame inner unit and the process frame front cover are integrally attached prior to the attachment of the development device 2. This is a correct attachment operation. Moreover, in the figure, the development device portion 2*a* is shown attached already, whereas the development device portions 2*b* and 2*c* are shown as being in the process of attachment.

In order for the development device 2 and the process frame body 11 to be arranged in the apparatus main body at high density and with high accuracy, a predetermined attachment/detachment order must be followed. In the image forming apparatus 100 of the embodiment, on the attachment order, first comes the process frame body 11, then the development device 2. The detachment order is reverse to the attachment order, that is, first comes the development device, then the process frame body 11. The process frame body 11 has a guide portion 112 for guiding a to-be-guided shaft 22 of the development device 2 during the attachment of the development device 2. Moreover, after the attachment of the process frame body 11 to the apparatus main body, part of the process frame body 11 is exposed out of the apparatus main body (part of the process frame front cover). At the lower position of this part is disposed a frame detachment lever 113. The frame detachment lever 113 disposed in the process frame body 11 acts as frame securing means which is, in the attachment of the process frame body 11, fitted to a certain portion of the apparatus main body to secure the process frame body 11, and releases, in the detachment thereof, the fitting to the certain portion by user's operation.

FIGS. 3A through 3D are views showing the order in which the development device 2 and the process frame body 11 are attached. Note that, in the figures showing the attachment order, the development device 2 and the process frame body 11 are schematically illustrated, and the attachment direction is perpendicular to the plane of the paper showing the figures, that is, the attachment is carried out from the front to the rear. Moreover, looking in a direction substantially perpendicular to the attachment direction, the surface of the development device 2 and the process frame body 11 is defined as the front surface, and the surface thereof opposite to said surface is defined as the back surface.

Figure 3A:
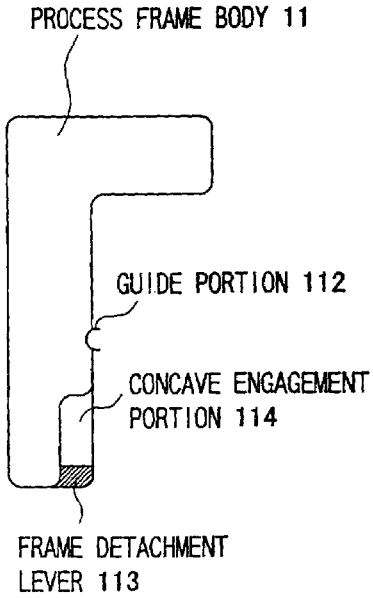
FIGS. 3A through 3D are views showing an order in which a development device and a process frame body are attached.

Firstly, at Step 1, the process frame body 11 is placed at a predetermined position of the image forming section A of the apparatus main body (refer to FIG. 3A). In that side part of the process frame body 11 which faces the development device 2 is formed the guide portion 112 as a groove-like fitting portion. The guide portion 112 serves to lead and guide the development device 2 along the attachment direction during the attachment of the development device 2, so that the development device 2 is positioned accurately with respect to the photoconductive drum 3. When the development device 2 is pressed into contact or out-of-contact with the process frame body 11 (pressure-contact/separating operation), the guide portion 112 is fitted to the to-be-guided shaft 22 acting as a pivot axis about which the development device 2 is rotated. Thus, the guide portion 112 has a C-shaped or U-shaped sectional profile, and is formed in the development device 2-side side portion of the process frame body 11, along the attachment direction. The to-be-guided shaft 22 may be continuously formed along the entire length of the development device 2 in the attachment direction, or maybe discontinuously formed only at the positions close to both ends of the development device.

Figure 3B:
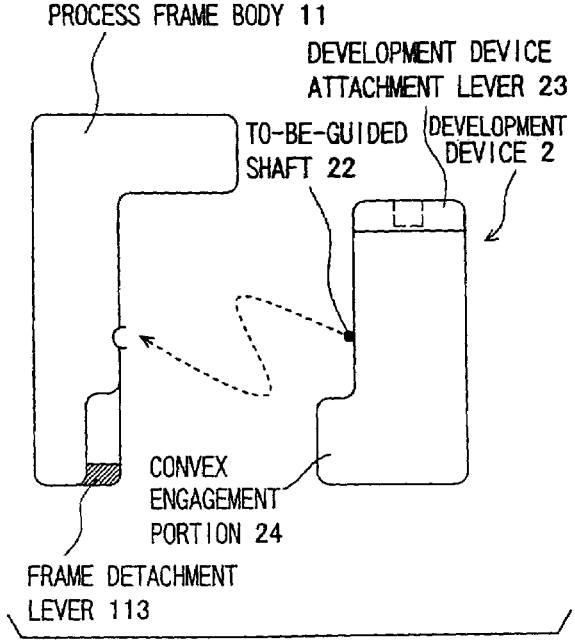
Figure 3C:
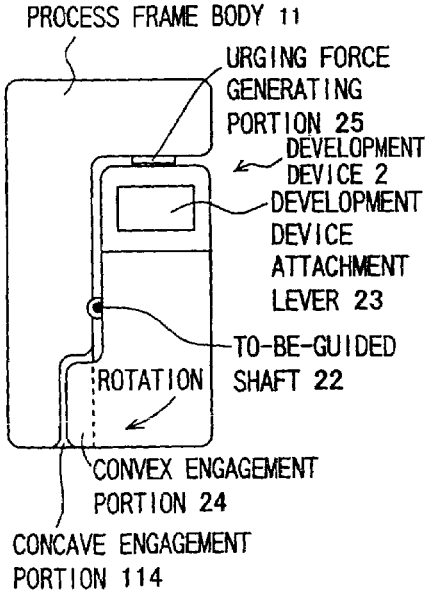
Figure 3D:
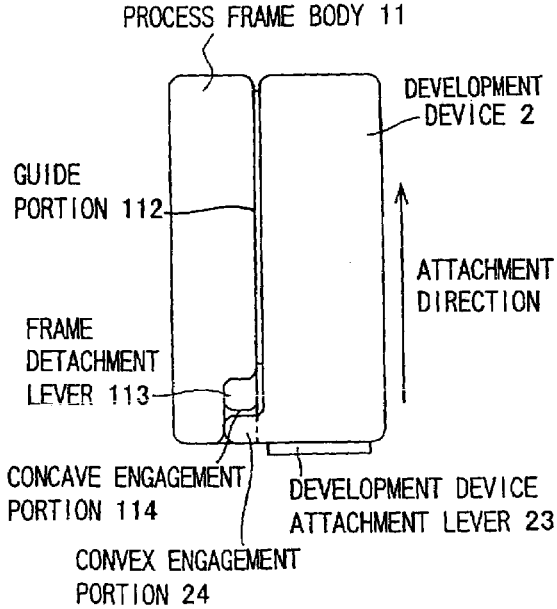

By constructing the development device 2 and the process frame body 11 in that way, at Step 2, the development device 2 is supported through the to-be-guided shaft 22 fitted to the guide portion 112 of the process frame body 11, and simultaneously the to-be-guided shaft 22 is guided along the inner surface of the guide portion 112; wherefore the development device 2 is inserted into the apparatus main body (refer to FIG. 3B). FIG. 3D is a plan view showing the development device 2 and the process frame body 11 after completion of Step 2. A convex engagement portion 24 of the development device 2 is, in association with the attachment operation of the development device 2, engaged with a concave engagement portion 114 of the process frame body 11 which has been attached first, from the front side in the attachment direction, i.e. from below upward as viewed in the paper showing FIG. 3D, so as to cover the frame detachment lever 113. Moreover, in association with the detachment operation of the development device 2, the convex engagement portion 24 is disengaged from the concave engagement portion 114. The guide portion 112, the to-be-guided shaft 22, the convex engagement portion 24, and the concave engagement portion 114 are attachment/detachment order controlling means.

The frame detachment lever 113 is arranged in the concave engagement portion 114. As shown in FIG. 3D, in association with the attachment operation of the development device 2, the frame detachment lever 113 is covered with the convex engagement portion 24 acting as an inhibitory portion. Moreover, in association with the detachment operation of the development device 2, the frame detachment lever 113 is released from the convex engagement portion 24.

In this way, once the development device 2 is attached, the frame detachment lever 113 is covered with the convex engagement portion 24. Thus, at the time of attachment of the development device 2, users are not allowed to operate the frame detachment lever 113. So long as the frame detachment lever 113 is kept in nonoperating status, the process frame body 11 cannot be detached from the apparatus main body. As a result, occurrence of an error in the detachment order can also be prevented.

In the image forming apparatus 100 of the embodiment, while the process frame body 11 is left unattached to the apparatus main body, the development device 2 is not attachable thereto. That is, in this state, the guide portion for guiding the development device 2 is absent within the apparatus main body. Thus, the development device 2 cannot be attached and positioned properly unless the process frame body 11 is attached to the apparatus main body first. This structure helps protect each constituent component from breakage and breakdown attributed to an error in the attachment/detachment order. Moreover, the convex engagement portion 24 is formed integrally with the development device 2 so as to jut into the attachment path for the process frame body 11. With this structure, if the development device 2 is inadvertently attached to the apparatus main body first, the process frame body 11 is no longer attachable thereto. More specifically, the convex engagement portion 24 is created by shaping part of the development device 2 main body into a piece of block. Even if users attach the development device 2 to the apparatus main body first through an attachment-order mistake and then try to attach the process frame body 11, since the convex engagement portion 24 interferes with a portion C corresponding to the concave engagement portion 114 on the back surface of the process frame body 11, the process frame body 11 is inhibited from being attached. Moreover, since the convex engagement portion 24 is block-shaped, sufficiently high strength can be attained. Thus, when the development device 2 is attached first, the process frame body 11 can be no longer attached to the apparatus main body. Thereby, the advantage is gained that each constituent component can be protected against breakage and breakdown attributed to an error in the attachment/detachment order.

Moreover, as shown in the figures, the engagement portions 24 and 114 can be formed integrally with the development device 2 and the process frame body 11, respectively. This eliminates the need for attachment of extra components, which results in the manufacturing process being facilitated and the manufacturing cost being reduced. Further, the engagement portions 24 and 114 are brought into engagement with each other in association with the operation of the development device 2 and the process frame body 11. This eliminates the need for a driving mechanism and an electrical controlling device, which results in the structure of the attachment path being simplified and thus the attachment and detachment operations being easier.

The development device 2 is, like the development device portion 2*b*, 2*c* shown in FIG. 2, attached to the apparatus main body with its development device attachment lever 23 raised. The development device attachment lever 23 is so designed as to be rotatably moved from a position which is parallel to the attachment direction and perpendicular to the front surface of the development device 2 (a stand-up state) to a position which is perpendicular to the attachment direction and parallel to the front surface of the development device 2 (a folded state) In the attachment and detachment of the development device 2, the development device attachment lever 23 is used as a handle. The development device attachment lever 23 shown in FIG. 3B is in its stand-up state, whereas that shown in FIG. 3C is in its folded state.

In the state at Step 2, the part of the development device 2 above the to-be-guided shaft 22 is slightly inclined toward the process frame body 11, whereas the part below the to-be-guided shaft 22 is kept away from the process frame body 11.

At Step 3, upon changing the development device attachment lever 23 from the stand-up state to the folded state through rotation (pressure-contact operation), an urging force generating portion 25, acting as pressure-contact means, projects from the opening formed on the top surface of the development device 2. This urging force generating portion 25 abuts against the inner wall of the apparatus main body, as well as the undersurface of a bedplate and a stay which is suspended between the front-side frame and the back-side frame of the image forming apparatus so as to fasten these frames to each other. With the resultant urging force, a downward force is applied to the development device 2, and thereby the development device 2 is rotated clockwise about the to-be-guided shaft 22 inserted into the guide portion 112. The photoconductive drum 3 and the development roller 21 are disposed at the lower positions of the process frame body 11 and the development device 2, respectively, so as to be pressed into contact with each other when the development device 2 is rotated about the to-be-guided shaft 22. Thus, when an urging force is generated, the photoconductive drum 3 and the development roller 21 are pressed into contact with each other uniformly along the entire lengths thereof.

Note that the to-be-guided shaft 22 is disposed at a position such that, while the urging force generating portion 25 remains unprojected and thus no urging force is generated, the self weight of the development device 2 acts in such a direction as to separate the development roller 21 of the development device 2 from the photoconductive drum 3 of the process frame body 11. Thus, unless the urging force generating portion 25 is brought into abutment with, for example, the inner wall of the apparatus main body, by the pressure-contact operation using the development device attachment lever 23, the photoconductive drum 3 and the development roller 21 cannot make contact with each other. Thereby, the advantage is gained that, during the attachment of the development device 2, the surface of the photoconductive drum 3 can be protected against breakage attributed to the abutment between the photoconductive drum 3 and the development roller 21.

Figure 4A:
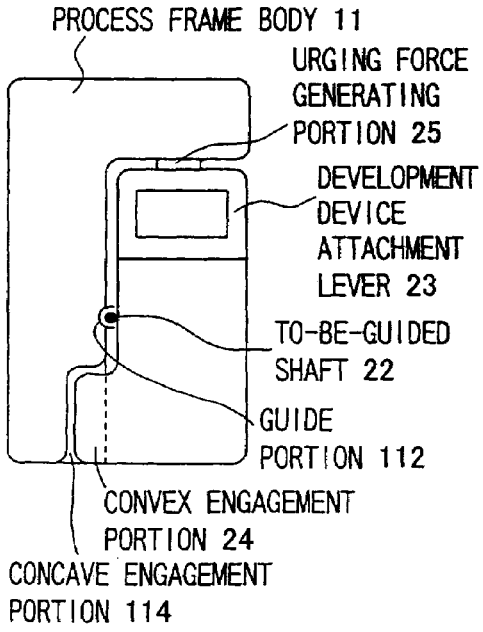
FIGS. 4A through 4C are views showing an order in which the development device and the process frame body are detached.
Figure 4B:
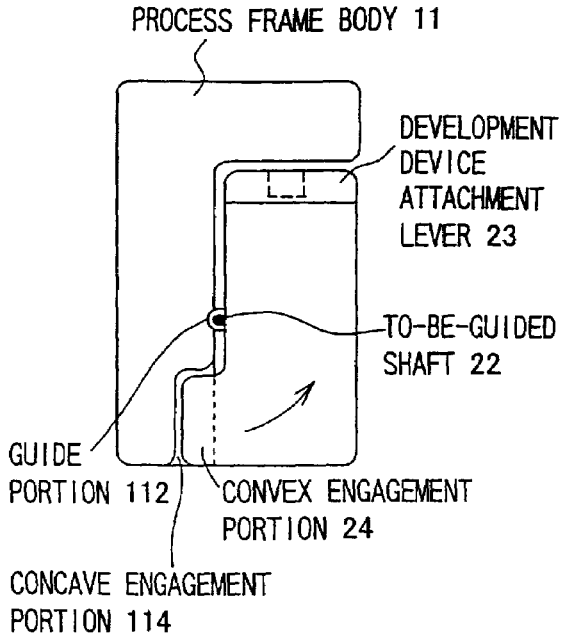
Figure 4C:
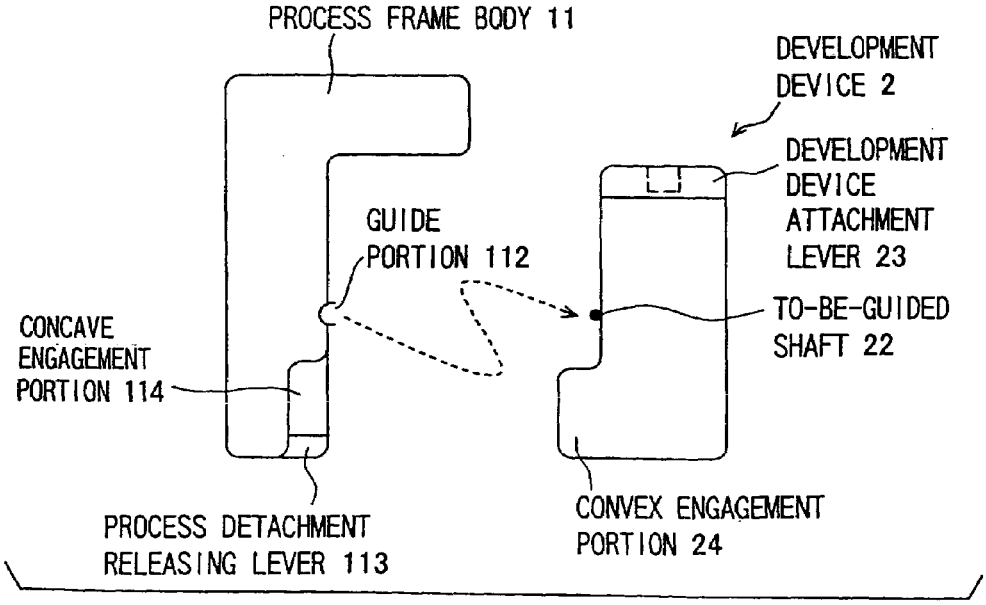

FIGS. 4A through 4C are views showing the order in which the development device 2 and the process frame body 11 are detached. Firstly, at Step 1, the development device attachment lever 23 is changed from the folded state to the stand-up state through rotation (separating operation). Thereupon, the urging force generating portion 25 is housed within the development device 2 (refer to FIG. 4A).

At Step 2, since no urging force is present, in contrast to the pressure-contact operation, the development device 2 rotates counterclockwise about the to-be-guided shaft 22, under its own weight. Resultantly, the development roller 21 of the development device 2 is separated from the photoconductive drum 3 of the process frame body 11 (refer to FIG. 4B).

At Step 3, the development device 2 is pulled out in the detachment direction reverse to the attachment direction to be detached from the apparatus main body (refer to FIG. 4C). Note that, at this time, since the frame detachment lever 113 of the process frame body 11 is kept in nonoperating status, the process frame body 11 is still coupled to the apparatus main body. Thus, it never occurs that the process frame body 11 is inadvertently pulled out, together with some portions of the development device, during the development device 2 detachment operation.

Upon completion of Step 3, the frame detachment lever 113 of the process frame body 11 becomes operable. Then, the frame detachment lever 113 is operated to release the retention of the process frame body 11 to the apparatus main body; wherefore the process frame body 11 is detached.

As explained thus far, the development roller 21 of the development device 2 and the photoconductive drum 3 of the process frame body 11 are separated from each other at Step 2. Thereby, at Step 3, the surface of the photoconductive drum 3 can be protected against breakage attributed to the abutment between the photoconductive drum 3 and the development roller 21 during the detachment of the development device 2. In addition, the development device 2 and the process frame body 11 are inhibited from being detached concurrently in a mutually-contacted state.

Note that, in this embodiment, the engagement portions are arranged, as shown in FIGS. 3 and 4, at the lowermost positions of the development device 2 and the process frame body 11. However, this does not suggest any limitation to the way the engagement portions are arranged. The engagement portions may be arranged in any given positions so long as they interfere with the process frame body 11 without fail when the development device 2 is attached first by mistake.

Figure 5:
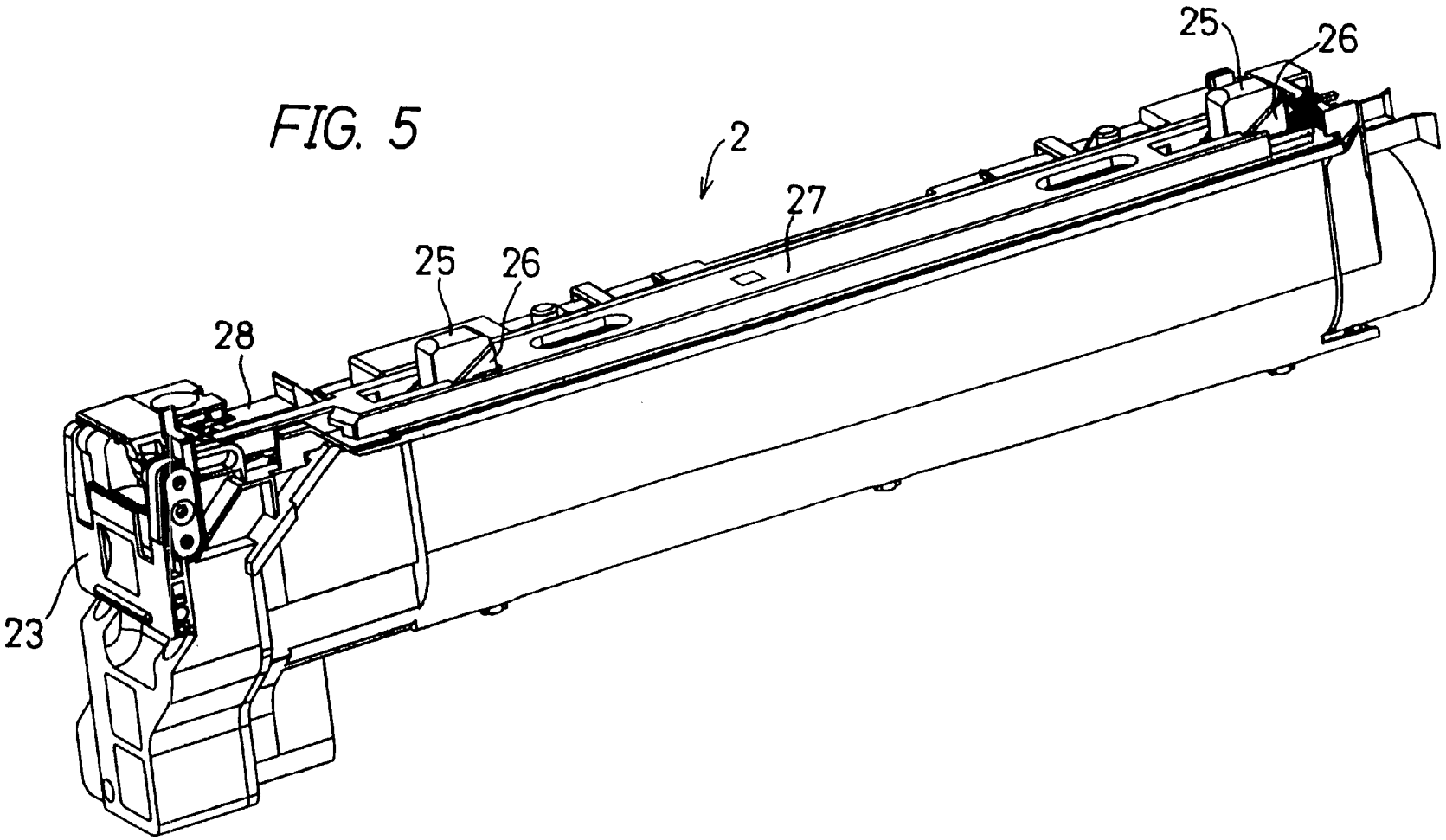
FIG. 5 is a perspective view of the development device, with its development device attachment lever folded.

Next, a detailed description will be given below as to the urging force generating portion 25 provided in the development device 2. FIG. 5 is a perspective view of the development device 2 with the development device attachment lever 23 folded. The action of the urging force generating portion 25 entailed by the operation of the development device attachment lever 23 is roughly as follows. During the pressure-contact operation, the development device attachment lever 23 is folded, and an operation rod 27 is slidingly moved toward the development device attachment lever 23 along the direction of the length of the development device 2. The urging force generating portion 25 is disposed on the top surface of the development device main body so as to be movable in upward and downward directions at a certain position.

Upon folding the development device attachment lever 23 to slide the operation rod 27, a slant portion 26 is moved concurrently with the operation rod 27. The slant portion 26 pushes the urging force generating portion 25 up, and consequently the urging force generating portion 25 juts out upward. Moreover, in accompaniment with the movement of the operation rod 27, a hook-shaped end of a locking member 28 juts out upward. The end of the locking member 28 is fitted to a certain inner-wall portion of the apparatus main body or a certain portion of the process frame body 11, thus preventing the development device 2 from being detached from the apparatus main body.

Figure 6:
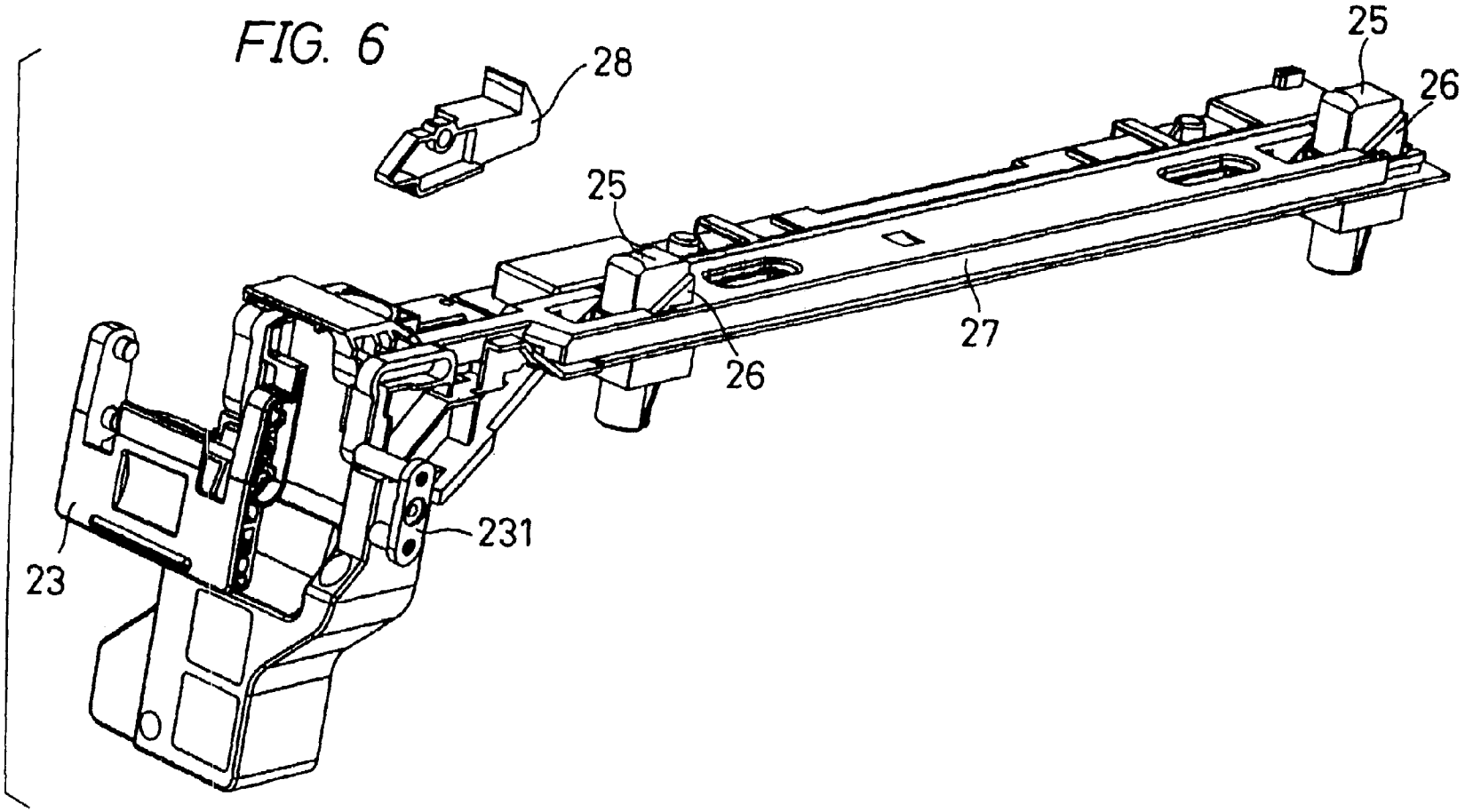
FIG. 6 is a perspective view of the development device, illustrating only its part pertaining to operation of an urging force generating portion.
Figure 7:
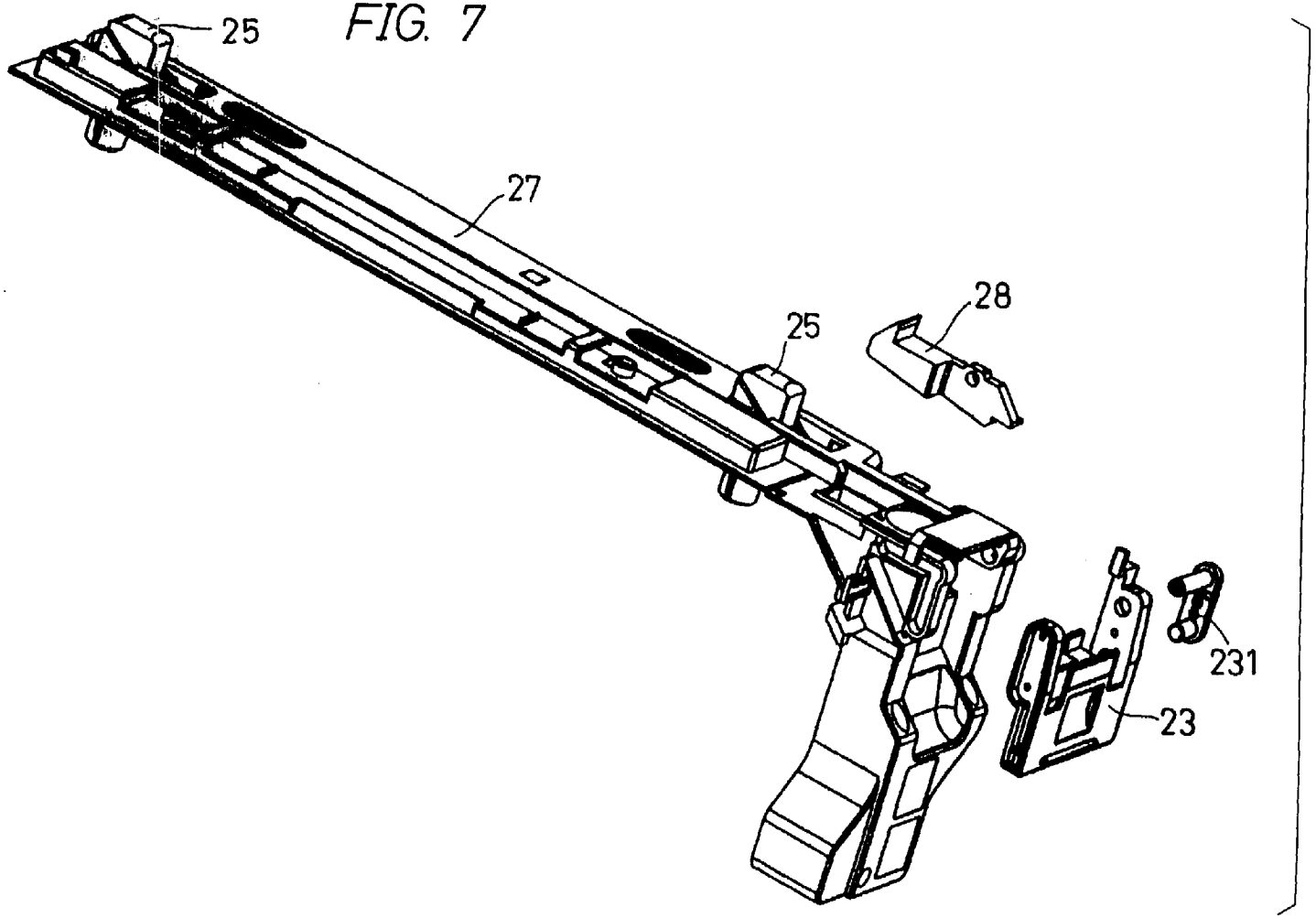
FIG. 7 is a perspective view of the development device, illustrating only its part pertaining to operation of the urging force generating portion.
Figure 8:
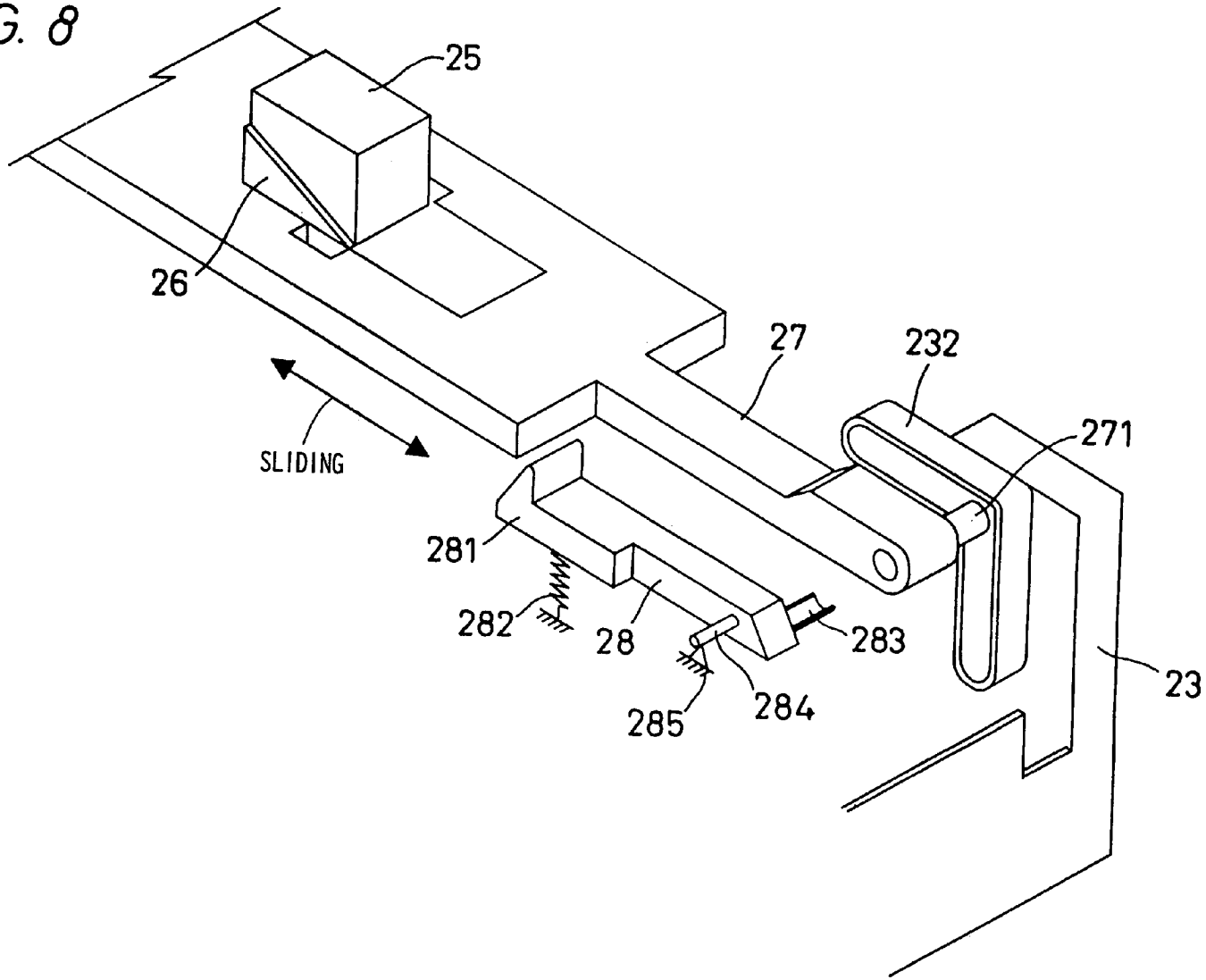
FIG. 8 is a schematic view for explaining actions of an operation rod and a locking member in accompaniment with the operation of the development device attachment lever.

FIG. 6 is a perspective view of the development device 2, illustrating only its part pertaining to the operation of the urging force generating portion 25. FIG. 7 is a perspective view of the same, as seen from the side opposite to FIG. 6. In the figure, the development device attachment lever 23, a lever attachment member 231, and the locking member 28 are each shown removed from the apparatus in the interest of understanding of their configurations. FIG. 8 is a schematic view for explaining the actions of the operation rod 27 and the locking member 28 in accompaniment with the operation of the development device attachment lever 23.

The development device attachment lever 23 has an L-shaped guiding groove 232 for guiding, during the operation of the development device attachment lever 23, a pin portion 271 disposed at the end of the operation rod 27. Upon rotating the development device attachment lever 23, the pin portion 271 is guided, and then the operation rod 27 is driven to slide by the action of the pin portion 271. During the pressure-contact operation using the development device attachment lever 23, the operation rod 27 is driven to slide toward the development device attachment lever 23 in the direction of the length of the development device 2, and simultaneously the slant portion 26 is driven to slide in the same direction. At this time, the urging force generating portion 25 is pushed up by the slant portion 26 to protrude upward. On the other hand, during the separating operation using the development device attachment lever 23, the operation rod 27 is driven to slide toward the side opposite to the development device attachment lever 23 in the direction of the length of the development device 2, and simultaneously the slant portion 26 is driven to slide in the same direction. At this time, the urging force generating port ion 25 is retracted downwardly with the movement of the slant portion 26.

Moreover, as the operation rod 27 is slidingly moved, the hook-shaped end 281 of the locking member 28 is moved upward and downward. The hook-shaped end 281 is rockably coupled to the top surface of the development device 2 main body by a supporting spring 282. The locking member 28 has, at its end opposite to the hook-shaped end 281, a regulating piece 283 with which the operation rod 27 makes contact during its sliding movement. The locking member 28 also has a pivot shaft 284 which is centerwardly located relative to the regulating piece 283. The pivot shaft 284 is supported by a supporting portion 285 formed on the top surface of the development device 2.

Figure 9A:
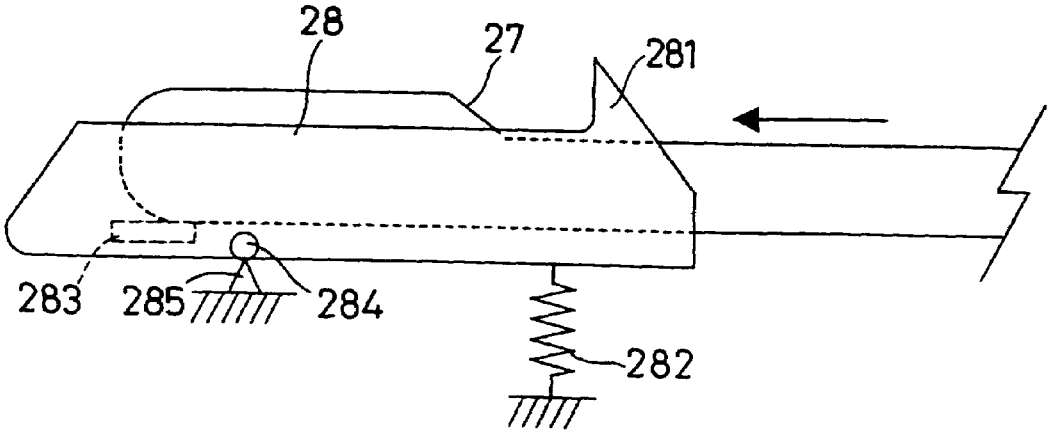
FIGS. 9A and 9B are schematic views for explaining operation of the locking member.
Figure 9B:
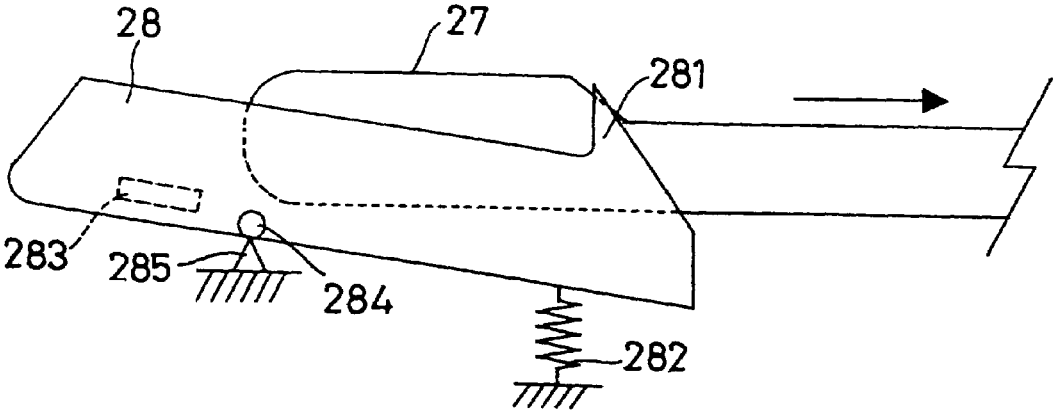

FIGS. 9A and 9B are schematic views for explaining the operation of the locking member 28, with 9A showing the action of the locking member 28 as observed in the pressure-contact operation, and 9B showing the action of the locking member 28 as observed in the separating operation. During the pressure-contact operation, the operation rod 27 is driven to slide in the direction indicated by the arrow in FIG. 9A, and the end of the operation rod 27 is brought into contact with the regulating piece 283. The regulating piece 283 is disposed at a position such as to make contact with the undersurface of the end of the operation rod 27. Upon sliding the operation rod 27, its end makes contact with the regulating piece 283 to push it down, and thereby the hook-shaped end 281 is pushed up, on the pivot shaft 284 acting as a fulcrum, against the resilient force exerted by the supporting spring 282. The upwardly-pushed hook-shaped end 281 is fitted to the inner wall of the apparatus main body or a certain position of the process frame body, thus preventing the development device 2 from being detached from the apparatus main body.

During the separating operation, the operation rod 27 is driven to slide in the direction indicated by the arrow in FIG. 9B, and the end of the operation rod 27 is moved away from the regulating piece 283. At the instant when the regulating piece 283 is freed from the force exerted thereon, the hook-shaped end 281 is moved downward under the resilient force of the supporting spring 282. The downwardly-moved hook-shaped end 281 is disengaged from the predetermined fitting portion, thus achieving detachment of the development device 2 from the apparatus main body.

Figure 10A:
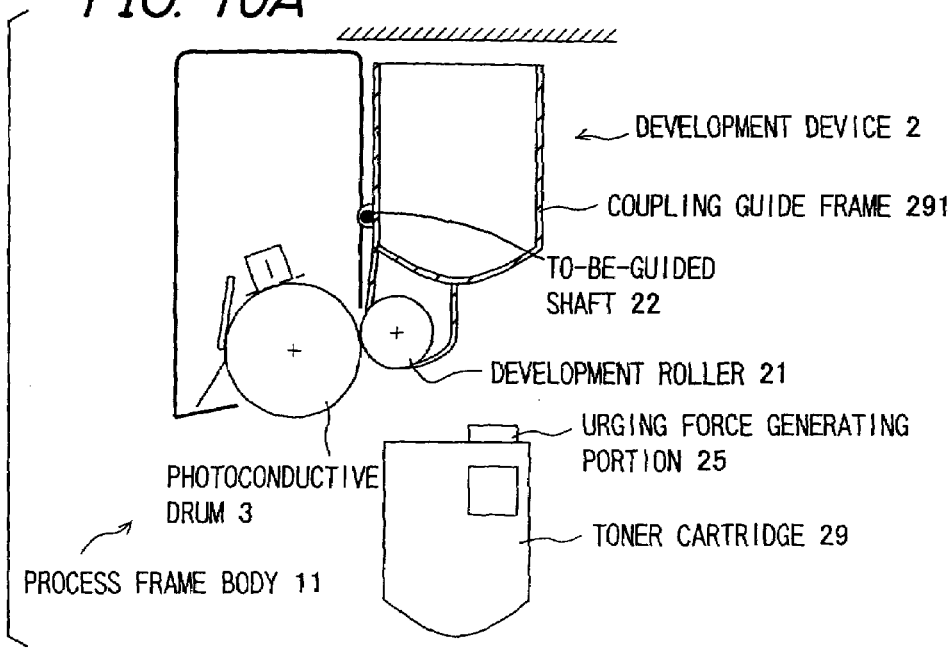
FIGS. 10A and 10B are views showing another embodiment of the invention.
Figure 10B:
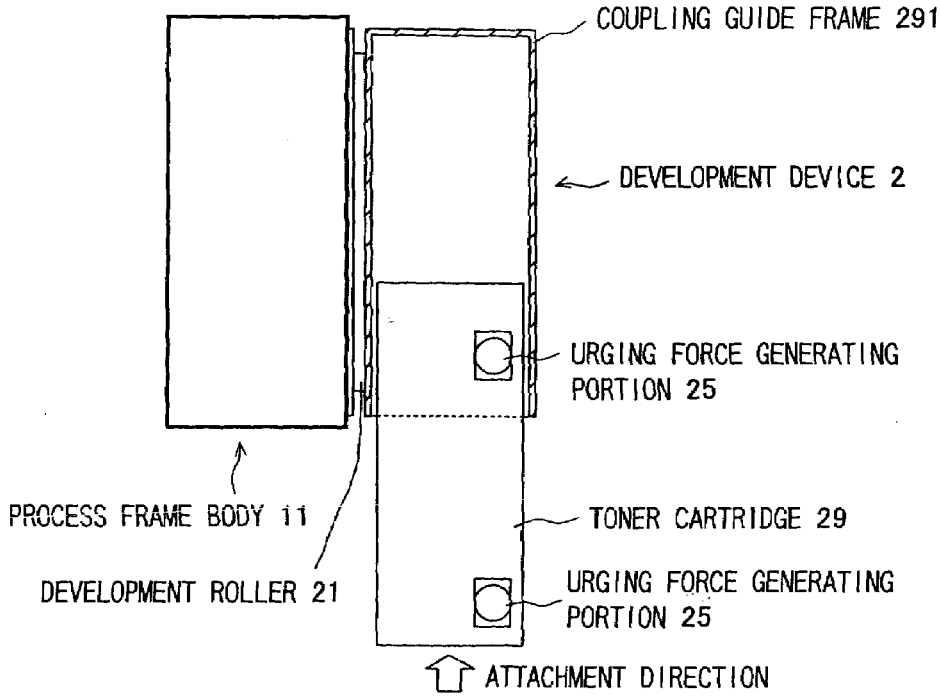

FIGS. 10A and 10B are views of another embodiment of the invention, with FIG. 10A showing the section as observed when the development device 2 and the process frame body 11 are sectioned along a direction perpendicular to the attachment direction, and FIG. 10B showing a plan view. In this embodiment, the toner cartridge 29 is made separable from the development device 2 main body The urging force generating portion 25 is disposed on the top surface of the toner cartridge 29. The process frame body 11 has basically the same structure as that of the above-described embodiment, and the attachment order for the process frame body 11 and the development device 2 is also the same.

The development device 2 has a coupling guide frame 291 for accommodating therein the toner cartridge 29. The other components such as the development roller 21 and the to-be-guided shaft 22 each have basically the same structure as that of the above-described embodiment.

On the attachment order, at first the process frame body 11 is attached to the apparatus main body, and then the development device 2 is inserted therein by fitting the to-be-guided shaft 22 into the guide portion 112 of the process frame body 11. At this time, the toner cartridge 29 is yet to be mounted in the development device 2. FIG. 10A shows a state in which the development device 2 is attached, with the toner cartridge 29 left unmounted. In this state, in the development device 2, the part of the coupling guide frame 291 above the to-be-guided shaft 22 is slightly inclined toward the process frame body 11, whereas the part below the to-be-guided shaft 22 is kept away from the process frame body 11.

Figure 11:
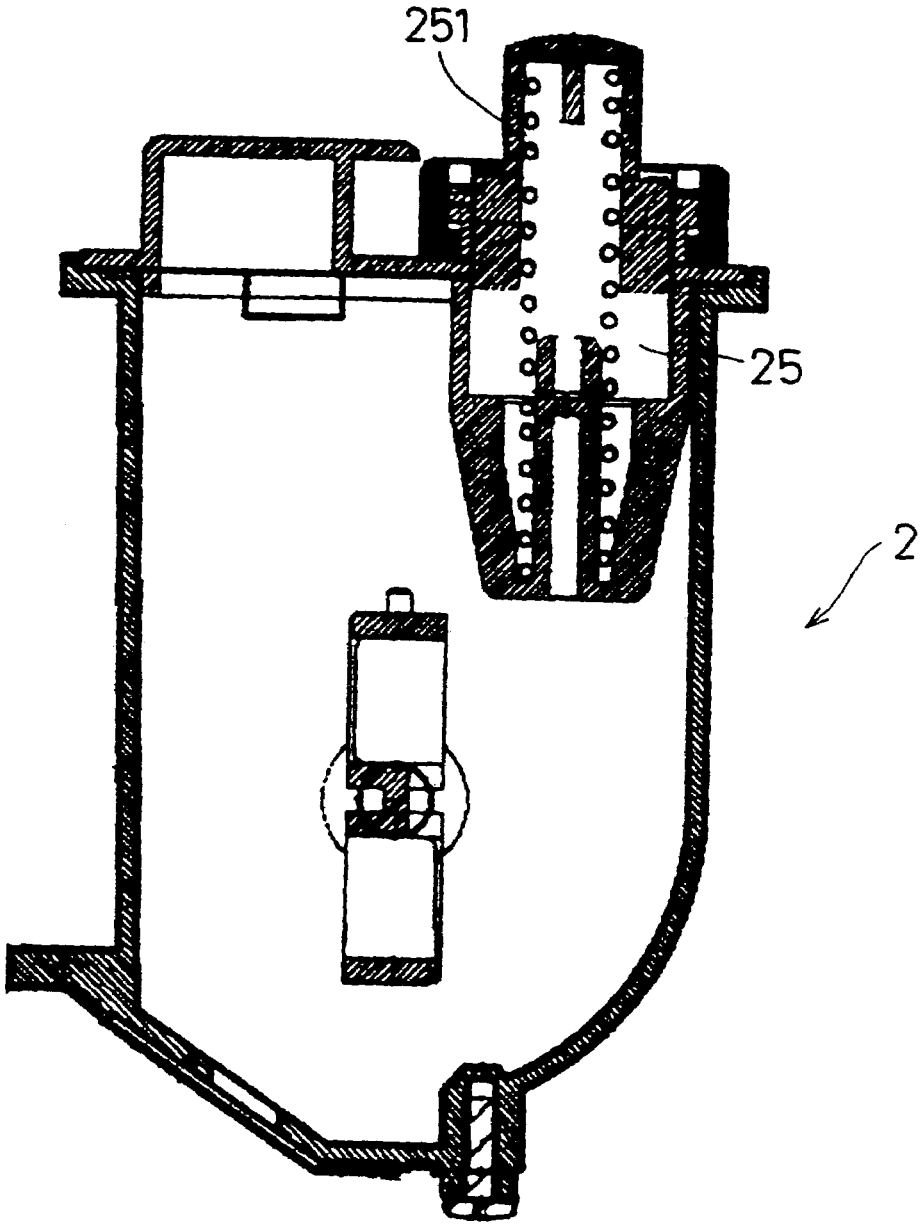
FIG. 11 is a sectional view showing a toner cartridge including the urging force generating portion.

Next, the toner cartridge 29 is mounted in the coupling guide frame 291. FIG. 11 is a sectional view showing the toner cartridge 29 including the urging force generating portion 25. The urging force generating portion 25 formed on the top surface of the toner cartridge 29 incorporates a spring 251. The urging force generating portion 25 remains projecting from the top surface, except when the toner cartridge 29 is mounted in the coupling guide frame 291. At the time of mounting of the toner cartridge 29 in the coupling guide frame 291, the urging force generating portion 25 is pressed against the inner wall of the apparatus main body or other parts, resulting in an urging force being generated by the resilient force of the incorporated spring 251.

Figure 12A:
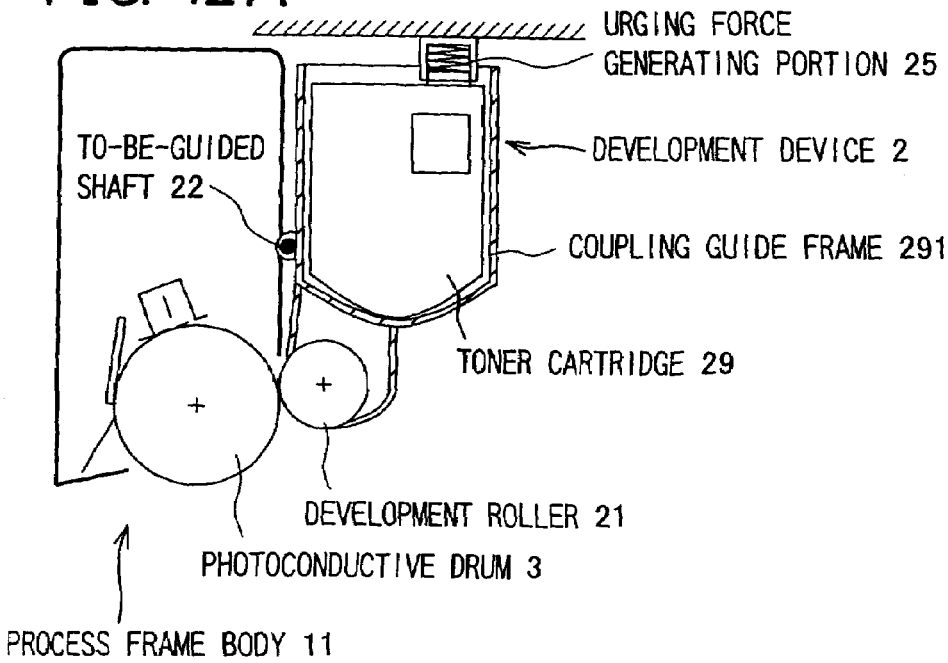
FIGS. 12A and 12B are views showing a state in which the toner cartridge is mounted.
Figure 12B:
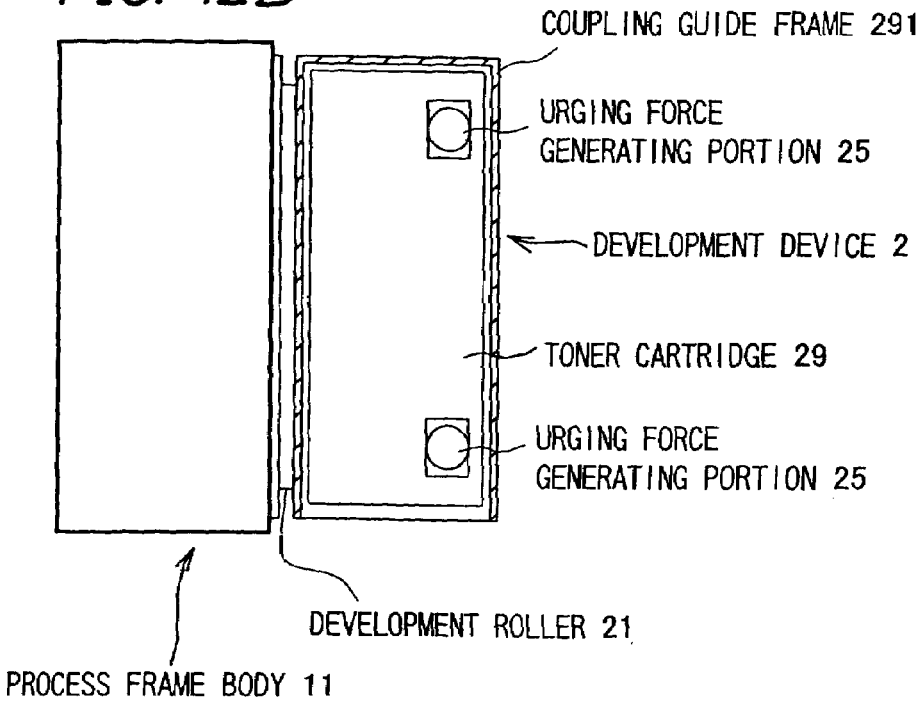

FIGS. 12A and 12B are views showing a state in which the toner cartridge 29 is mounted, with FIG. 12A showing the section as observed when the development device 2 and the process frame body 11 are sectioned along a direction perpendicular to the attachment direction, and FIG. 12B showing a plan view. Upon mounting the toner cartridge 29 in the coupling guide frame 291, the urging force generating portion 25 is pressed into contact with a predetermined holding surface such as the inner wall of the apparatus main body. By the application of pressure, the incorporated spring 251 contracts to generate a spring force. By the resultant urging force, the development device 2 is pushed down. The downwardly-pushed development device 2 is then rotated clockwise about the to-be-guided shaft 22, and thereby the development roller 21 and the photoconductive drum 3, which are arranged at the lower positions of the development device 2 and the process frame body 11, respectively, are pressed into contact with each other. By adjusting the position and number of the urging force generating portion 25 properly, the photoconductive drum 3 and the development roller 21 can be pressed into contact with each other uniformly along the entire lengths thereof.

Note that, in the development device 2, the strength of the spring force exerted by the urging force generating portion 25 (clockwise turning moment produced around the to-be-guided shaft 22) is adjusted to be constantly greater than the self weight of the development cartridge acting in such a direction as to separate the development device from the process frame body 11 (counterclockwise turning moment produced around the to-be-guided shaft 22). Thereby, upon generation of an urging force, the development device 2 is rotated clockwise about the to-be-guided shaft 22.

The toner cartridge 29 has a relatively durable casing structure (substantially the so-called closed sectional structure) and provides sufficiently high strength and rigidity on its own. Thus, when inserted the toner cartridge 29 into the coupling guide frame 291 having the so-called opened sectional structure, the toner cartridge 29 functions not only as part of the structure body of the development device 2 but also as a reinforcement member for the development device 2. At this time, the toner cartridge 29 is deformed little in spite of the abutment against the holding surface. Thus, the urging force exerted by the urging force generating portion 25 can be effectively transmitted to the development device 2 as a whole, so that the development roller 21 is pressed into contact with the photoconductive drum 3 uniformly along the entire length thereof.

Note that, in the above description, although the image forming apparatus for forming color images using four-color toner is explained as the preferred embodiment, the image forming apparatus type is not limited thereto. For example, an image forming apparatus for forming monochromatic images using black toner alone can be taken up, so long as it is of the type in which a plurality of functional units, each of which is formed of a combination of a plurality of components and has a certain responsibility for image formation, are attached and detached in a predetermined order.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image forming apparatus main body;

a process frame body including at least a photoconductive body, image forming means for forming an electrostatic latent image on a surface of the photoconductive body, and a frame main body for holding the photoconductive body and the image forming means; and a development device including at least development means for developing the electrostatic latent image using toner, toner supply means for feeding toner to the development means, and a development device main body for holding the development means and the toner supply means, the process frame body and the development device being attachable to and detachable from the image forming apparatus main body in a predetermined order, the process frame body and the development device each having attachment/detachment order controlling means for preventing the process frame body and the development device from being attached and detached in an order different from the predetermined order;

wherein the process frame body further comprises frame securing means which is, in attachment operation, fitted to a certain portion of the apparatus main body to secure the process frame body, and releases, in detachment operation, the fitting to the certain portion by user's operation, and wherein, in cases where the order in which the process frame body and the development device are detached is that first comes the development device, then the process frame body, the attachment/detachment order controlling means of the development device has an inhibitory portion for inhibiting operation of the frame securing means by users, when the process frame body and the development device are attached.

2. The image forming apparatus of claim 1, wherein the attachment/detachment order controlling means is created by forming part of each of the process frame body and the development device into a certain shape.

3. The image forming apparatus of claim 1, wherein the attachment/detachment order controlling means is built as an engagement portion which is, in the attachment of the process frame body and the development device, brought into engagement state in association with attachment operation of the component to be attached subsequently, and is, in the detachment of the process frame body and the development device, brought into disengagement state in association with detachment operation of the component to be detached first.

4. The image forming apparatus of claim 3, wherein, of the engagement portions respectively provided in the process frame body and the development device, one is formed as a convexity and another is formed as a concavity whose configuration conforms to that of the convexity.

5. The image forming apparatus of claim 1, wherein, in cases where the order of attachment of the process frame body and development device is such that first the process frame body is attached and then the development device is attached, the attachment/detachment order controlling means of the process frame body is formed of a guide portion for guiding the attachment of the development device, whereas the attachment/detachment order controlling means of the development device is formed of a to-be-guided portion which is guided by the guide portion.

6. The image forming apparatus of claim 1, wherein, in the attachment of the process frame body and the development device, the inhibitory portion covers the frame securing means in association with the attachment operation of the component to be attached subsequently, and meanwhile, in the detachment of the process frame body and the development device, the inhibitory portion releases the frame securing means in association with the detachment operation of the development device.

7. The image forming apparatus of claim 1, wherein the development device further comprises pressure-contact means for contacting under pressure or separating the photoconductive body and the development means by user's operation, when the process frame body and the development device are attached.

8. The image forming apparatus of claim 7, wherein the toner supply means is made attachable to and detachable-from the development device main body, and wherein the pressure-contact means acts to contact under pressure or separate the photoconductive body and the development means in accordance with the attachment and detachment of the toner supply means to and from the development device.

9. An image forming apparatus comprising:

an image forming apparatus main body including an opening for receiving first and second functional units;

a first functional unit having an image forming capability received in said opening and having a guide structure and a release mechanism for releasing said first functional unit from said opening;

a second functional unit received in said opening and comprising a guide element received in said guide structure and a first portion;

wherein said first portion is configured to cover said release mechanism when said first functional unit and said second functional unit are properly installed in said opening and to prevent said first functional unit from being installed in said opening after said second functional unit is installed in said opening;

whereby said first functional unit and said second functional unit may only be installed and removed in a predetermined order.

10. The image forming apparatus of claim 9 wherein said first functional unit comprises a process frame body and said second functional unit comprises a development device.

11. The image forming device of claim 10 wherein said guide structure comprises a groove and said guide element comprises a rod receivable in said groove.

* * * * *